US006536355B1

(12) United States Patent
Amemiya

(10) Patent No.: US 6,536,355 B1
(45) Date of Patent: Mar. 25, 2003

(54) CLEANING MODEL RAILROAD CAR

(75) Inventor: Hiroki Amemiya, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 09/677,915

(22) Filed: Oct. 6, 2000

(51) Int. Cl.[7] ..... B61D 17/00
(52) U.S. Cl. ..... 105/1.5; 104/279
(58) Field of Search ..... 105/1.5, 238.2; 104/279; 446/447, 467; 51/178; 15/49.1, 50.1, 54, 55, 78, 87, 98, 312.1, 313

(56) References Cited

U.S. PATENT DOCUMENTS 1,483,674 A * 2/1924 Owen ..... 15/49.1
3,955,642 A * 5/1976 Shino et al. ..... 180/164
4,101,014 A * 7/1978 Matheson ..... 191/62
4,381,628 A * 5/1983 Dicke ..... 51/170 TL
4,729,141 A * 3/1988 Berg et al. ..... 15/49
4,754,521 A * 7/1988 Zoni ..... 15/340
5,437,233 A * 8/1995 Richter ..... 104/279
5,673,626 A * 10/1997 Jaeggi ..... 104/279
5,816,168 A * 10/1998 Poissant ..... 104/279
5,904,100 A * 5/1999 Flndley et al. ..... 104/279
5,943,724 A * 8/1999 Erko et al. ..... 15/49.1
6,052,854 A * 4/2000 Besel et al. ..... 15/50.1
6,163,915 A * 12/2000 Kaczmarz et al. ..... 15/49.1
6,295,682 B1 * 10/2001 Klucznik ..... 15/320

FOREIGN PATENT DOCUMENTS

GB 2174630 A * 11/1986 ..... E01H/8/10

* cited by examiner

*Primary Examiner*—S. Joseph Morano
*Assistant Examiner*—Frantz F. Jules
(74) *Attorney, Agent, or Firm*—Staas & Halsey LLP

(57) ABSTRACT

A cleaning model railroad car which can do various cleaning by itself and which can do cleaning effectively regardless of a travel speed thereof. The cleaning model railroad car 8 comprises: a car body 20; wheels 8*b* attached to the car body, for riding on rails 3*a* and 3*b*; a motor 8*a* attached to the car body, to which an electrical current is supplied through the wheels on the rails and a motor shaft 8*e* is provided; a dust collection chamber 21 provided at the car body; a head mounting concave portion 23 provided below the motor, for opening toward a lower surface of the car body below thereof and communicating with the dust collection chamber; and a cleaning head 24 or 25 provided at the motor shaft projected in the head mounting concave portion, which can be installed to and removed from the motor shaft.

11 Claims, 7 Drawing Sheets

CLEANING MODEL RAILROAD CAR

BACKGROUND OF THE INVENTION

1. Field of the Invention

The present invention relates to a cleaning model railroad car for cleaning rails and the periphery thereof while the cleaning model railroad car is running on the rails.

2. Description of Related Art

According to an earlier development, various cleaning model railroad cars are known and can be roughly divided into two types.

According to the cleaning model railroad car, one type of the cleaning model railroad car comprises a car body, wheels for riding on rails, a motor to which an electrical current is supplied through the wheels on the rails, and a dust collection fan (a cleaning head) to be rotatable by the motor, wherein the wheels, the motor, and the dust collection fan are attached to the car body.

The other type of the cleaning model railroad car comprises a car body, wheels for riding on rails, a motor to which an electrical current is supplied through the wheels on the rails, and a dry polishing head as a file (a cleaning head) to be rotatable by the motor, wherein the wheels, the motor, and the file are attached to the body.

According to the cleaning model railroad car comprising the dust collection fan, it is possible to clean any dust or the like from the rails and the periphery thereof while the cleaning model railroad car is running on the rail. Further, according to the cleaning model railroad car comprising the dry polishing head, it is possible to remove any carbon adhered to the rails and any rust on the rails.

However, according to an earlier development, when cleaning any dust from the rails and when removing any carbon and any rust from the rails, it is necessary to use the different type of cleaning model railroad car. Accordingly, it is necessary for model railroading enthusiasts to be required the high cost in order to clean the rails.

Further, a model railroad car that can control a drive motor for rotating wheels by a pulse voltage modulated a pulse width to change a travel speed thereof is known.

According to the model railroad car to which the cleaning model railroad car as described above is applied, an electrical current is supplied to a motor for driving a cleaning head through the wheels on the rails. Accordingly, the slower the travel speed of the model railroad car is, the slower the acting speed of the cleaning head is. Consequently, there has been the problem that it is not possible to clean effectively, or the like.

SUMMARY OF THE INVENTION

The present invention was developed in view of the above-described problems.

An object of the present invention is to provide a cleaning model railroad car which can do various cleaning by itself.

Another object of the present invention is to provide a cleaning model railroad car which can do cleaning effectively regardless of a travel speed thereof.

In accordance with one aspect of the present invention, a cleaning model railroad car (for example, a cleaning model railroad car 8 shown in FIGS. 1 and 3) comprises: a car body (for example, car body 20 shown in FIG. 3); wheels (for example, wheels 8*b* shown in FIG. 4) attached to the car body, for riding on rails (for example, feeding rails 3*a* and

3*b* shown in FIG. 1, that is a model railroad track); a motor (for example, a head drive motor 8*a* shown in FIGS. 4 and 7) attached to the car body, to which an electrical current is supplied through the wheels on the rails and a motor shaft (for example, a motor shaft 8*e* shown in FIG. 7) is provided; a dust collection chamber (for example, a dust collection chamber 21 shown in FIG. 7) provided at the car body; a head mounting concave portion (for example, a head mounting concave portion 23 shown in FIG. 7) provided below the motor, for opening toward a lower surface of the car body below thereof and communicating with the dust collection chamber; and a cleaning head (for example, a dust collection fan 24 as shown in FIGS. 7 and 8, and a polishing head 25 shown in FIG. 9) provided at the motor shaft projected in the head mounting concave portion, which can be installed to and removed from the motor shaft.

In accordance with another aspect of the present invention, a cleaning model railroad car comprises: a car body; wheels attached to the car body, for riding on rails; a head mounting concave portion provided at the car body, for opening toward a lower surface of the car body below thereof; and a cleaning head provided at the head mounting concave portion, which can be installed to and removed from the head mounting concave portion.

According to the cleaning model railroad car as described above, the cleaning head can be installed to and removed from the car body so that it is possible to change the cleaning head to various types of cleaning heads. As a result, it is possible to clean the rails by one cleaning model railroad car as occasion demands.

Preferably, the cleaning model railroad car as described above, further comprises: a dust collection fan (for example, a dust collection fan 24 shown in FIG. 8) as the cleaning head.

Preferably, another type of the cleaning model railroad car as described above, further comprises: a motor attached to the car body, to which an electrical current is supplied through the wheels on the rails and a motor shaft is provided; a dust collection chamber provided at the car body, for communicating with the head mounting concave portion; and a dust collection fan as the cleaning head, provided at the motor shaft projected in the head mounting concave portion, which can be installed to and removed from the motor shaft and be rotated by the motor.

According to the cleaning model railroad car as described above, the cleaning model railroad car comprises the dust collection fan as the cleaning head so that it is possible to clean any dust and the like accumulated on the rails and the periphery thereof.

Preferably, the cleaning model railroad car as described above, further comprises: a dry polishing head (for example, a polishing head 25 shown in FIG. 9) as the cleaning head.

Preferably, another type of the cleaning model railroad car as described above, further comprises: a polishing head as the cleaning head. And preferably, the cleaning model railroad car, further comprises: a motor attached to the car body, to which an electrical current is supplied through the wheels on the rails and a motor shaft is provided; wherein the cleaning head is provided at the motor shaft projected in the head mounting concave portion, and can be installed to and removed from the motor shaft and be rotated by the motor.

The polishing head includes a dry polishing head and another type of polishing head. The dry polishing head is a paper, a file, a head to which a resin is attached, or the like. Another type of polishing head is a head to which a silicon cloth is attached or the like.

According to the cleaning model railroad car as described above, the cleaning model railroad car comprises the dry polishing head or the polishing head as the cleaning head so that it is possible to remove any carbon adhered to the rails and any rust on the rails.

Preferably, the cleaning model railroad car as described above, further comprises: a tank (for example, a tank 26 shown in FIG. 7) attached to the car body, to store a cleaning liquid therein; and a wiping unit (for example, a wiping unit 29 shown in FIG. 7) which can be installed to and removed from the car body, for wiping the rails with the cleaning liquid of the tank.

Preferably, the cleaning model railroad car as described above, further comprises: a tank (for example, a tank 26 shown in FIG. 7) attached to the car body, to store a cleaning liquid therein; and a wiping unit (for example, a wiping unit 29 shown in FIG. 7) attached to the car body so that which can be contacted with and separated from the rails, for wiping the rails with the cleaning liquid of the tank.

According to the cleaning model railroad car, the car body comprises the wiping unit for wiping the rails with the cleaning liquid so that it is possible to remove any carbon adhered to the rails more effectively.

Preferably, the cleaning model railroad car as described above, further comprises: a motor driving circuit (for example, a motor driving circuit 9 shown in FIG. 4) for driving the motor (for example, a head drive motor 8a shown in FIG. 4), comprising a full wave rectifier circuit (for example, a full wave rectifier circuit 9*a* shown in FIG. 4) and a smoothing capacitor (for example, a smoothing capacitor 9*b* shown in FIG. 4).

According to the cleaning model railroad car, a regulated power supply unit that is composed of the full wave rectifier circuit and the smoothing capacitor is provided on the motor driving circuit. Consequently, even if the cleaning model railroad car is applied to a model railroading for controlling a drive motor for rotating wheels by a pulse voltage modulated a pulse width thereof, it is possible to stably clean the rails regardless of the travel speed of the model railroad car.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

PREFERRED EMBODIMENT OF THE INVENTION

Hereinafter, an embodiment of a model railroading comprising a cleaning model railroad car according to the present invention will be explained with reference to FIGS. 1 to 9C, in detail.

Figure 1:
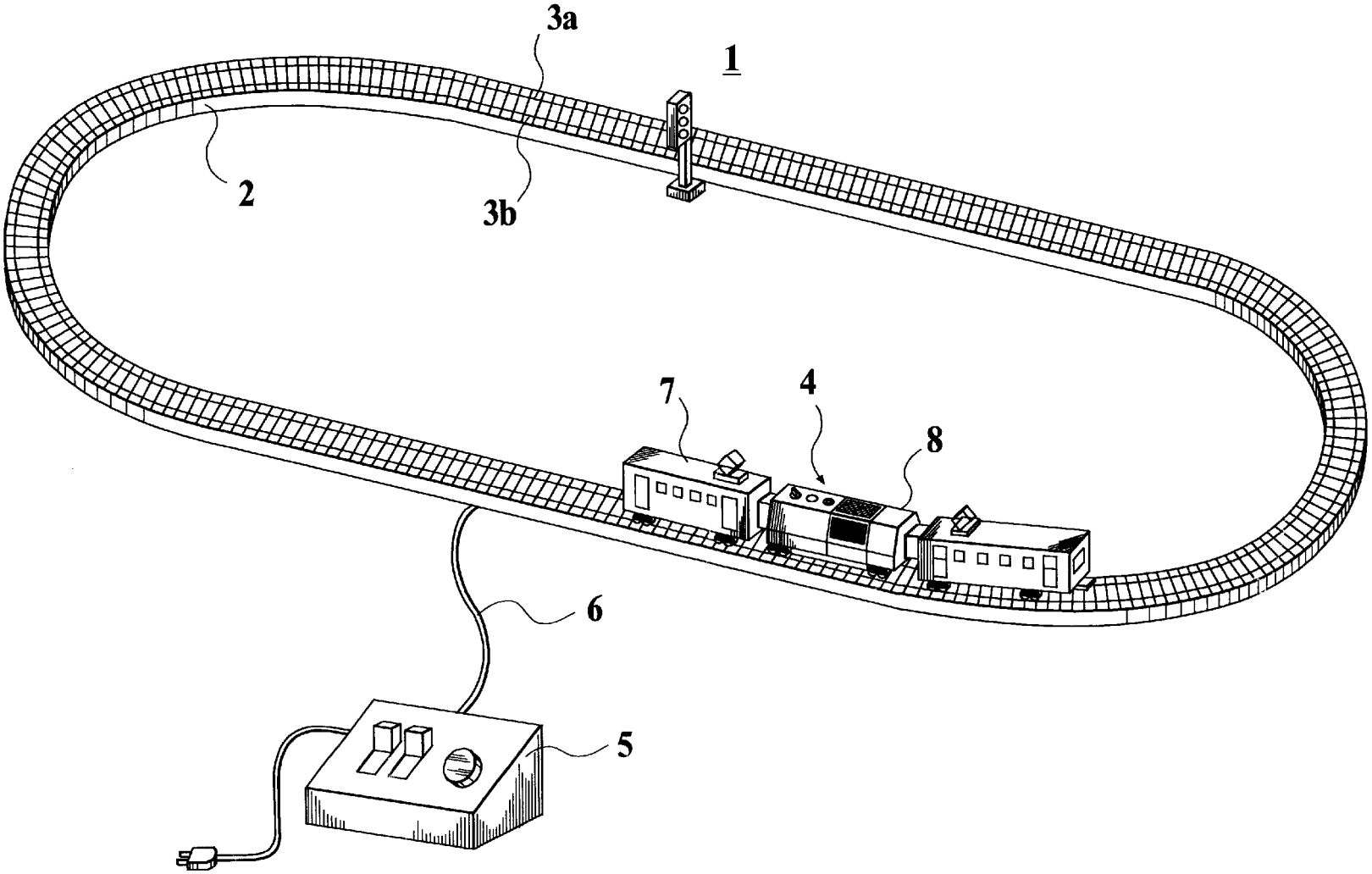
FIG. 1 is a perspective view of a model railroading to which a cleaning model railroad car according to an embodiment of the present invention is applied.

In FIG. 1, a model railroading comprising a cleaning model railroad car according to an embodiment of the present invention is shown.

The model railroading 1 comprises a track bed 2 made from insulation as plastic or the like and two feeding rails 3*a* and 3*b* attached on the track bed 2 in parallel. According to the model railroading 1, in order to run the model railroad car 4 on the rail, between two feeding rails 3*a* and 3*b*, the pulse voltage is supplied through a lead wire 6 from a control box 5.

The model railroad car 4 comprises a model tractor 7, as shown in FIG. 1.

Figure 2:
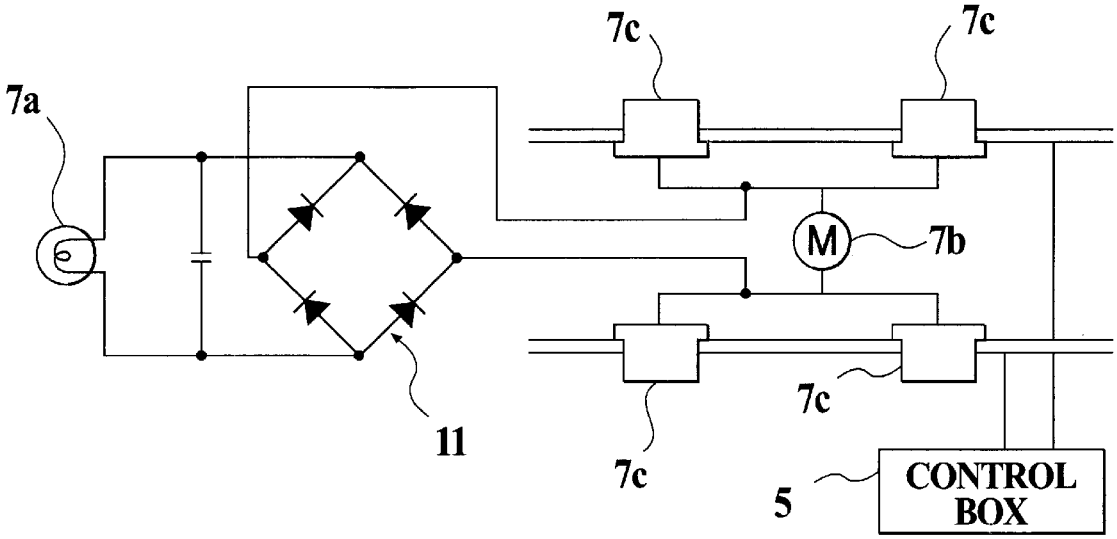
FIG. 2 is a circuit diagram showing an internal structure of a model tractor of the model railroading shown in FIG. 1.

In FIG. 2, a circuit diagram showing an internal structure of the model tractor 7 is shown. As shown in FIG. 2, a room light 7*a*, a wheel drive motor 7*b* and wheels 7*c* are installed into the model tractor 7. The room light 7*a* and the wheel drive motor 7*b* are operated on the pulse voltage supplied through the wheels 7*c* of the model tractor 7. In this case, a full wave rectifier circuit 11 is further installed into the model tractor 7 and connected to the room light 7*a*.

Further, the model railroad car 4 comprises a cleaning model railroad car 8 (with reference to FIG. 3) as shown in FIG. 1.

Figure 4:
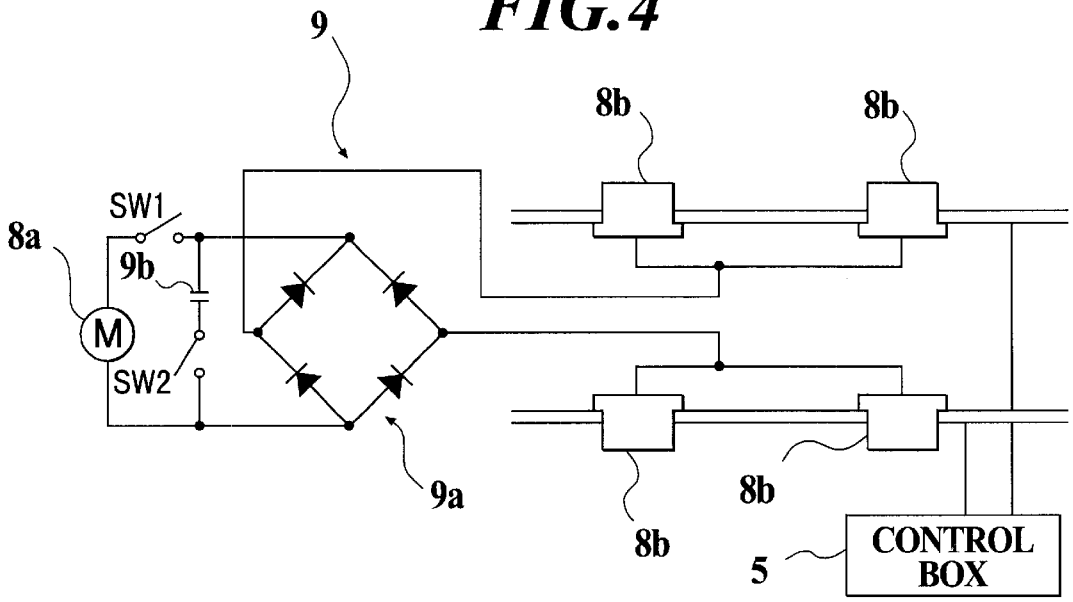
FIG. 4 is a circuit diagram showing an internal structure of the cleaning model railroad car shown in FIG. 3.

In FIG. 4, a circuit diagram showing an internal structure of the cleaning model railroad car 8 is shown. As shown in FIG. 4, a head drive motor 8*a* and wheels 8*b* are installed into the cleaning model railroad car 8. The head drive motor 8*a* is operated on the pulse voltage supplied through the wheels 8*b* of the cleaning model railroad car 8. In this case, a motor drive circuit 9 is further installed into the cleaning model railroad car 8. A full wave rectifier circuit 9*a*, a smoothing capacitor 9*b* and switches SW 1 and SW 2 are incorporated into the motor drive circuit 9, and the full wave rectifier circuit 9*a* and the smoothing capacitor 9*b* function as a voltage stabilization unit for the head drive motor 8*a*.

Figure 3:
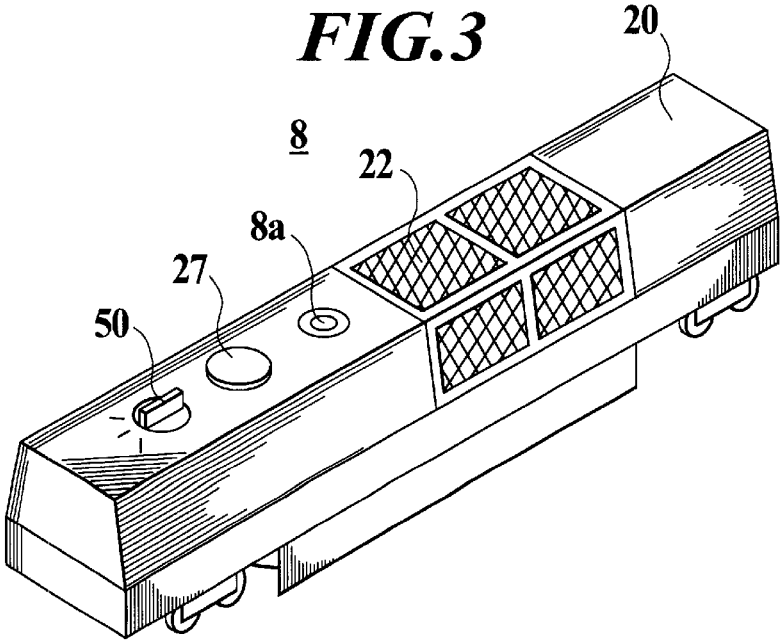
FIG. 3 is a perspective view of the cleaning model railroad car according to the embodiment of the present invention.

The switches SW 1 and SW 2 are controlled by a rotating operation of a rotating knob 50 (with reference to FIG. 3). Specifically, the rotating knob 50 can change to three modes. A first mode is one to turn both the switches SW 1 and SW 2 off, a second mode is one to turn the only switch SW 2 on, and a third mode is one to turn both the switches SW 1 and SW 2 on.

In the first mode, the head drive motor 8*a* does not operate because the head drive motor 8*a* is not connected to the motor drive circuit 9. In the second mode, the smoothing capacitor 9*b* does not operate because the smoothing capacitor 9*b* is not connected to the head drive motor 8*a* through the switch SW 1 so that the smoothing capacitor 9*b* does not take a load of the head drive motor 8*a*. In the third mode, the smoothing capacitor 9*b* operates because the smoothing capacitor 9*b* is connected to both ends of the head drive motor 8*a*, thereby the smoothing capacitor 9*b* supplies a current smoothed an output rectified by the full rectifier circuit 9*a* to the head drive motor 8*a*.

According to the effect of the third mode, it is possible to operate the head drive motor 8*a* when the wheel drive motor 7*b* does not operate by the pulse width modulation, or it is possible to keep the rotation of the head drive motor 8*a* to be a state with a relatively high speed when the rotation of the wheel drive motor 7*b* has become slowly by the pulse width modulation.

Further, a control box 5 is installed into the cleaning model railroad car 8. A model railroad car control device 10 is incorporated in the control box 5.

Figure 5:
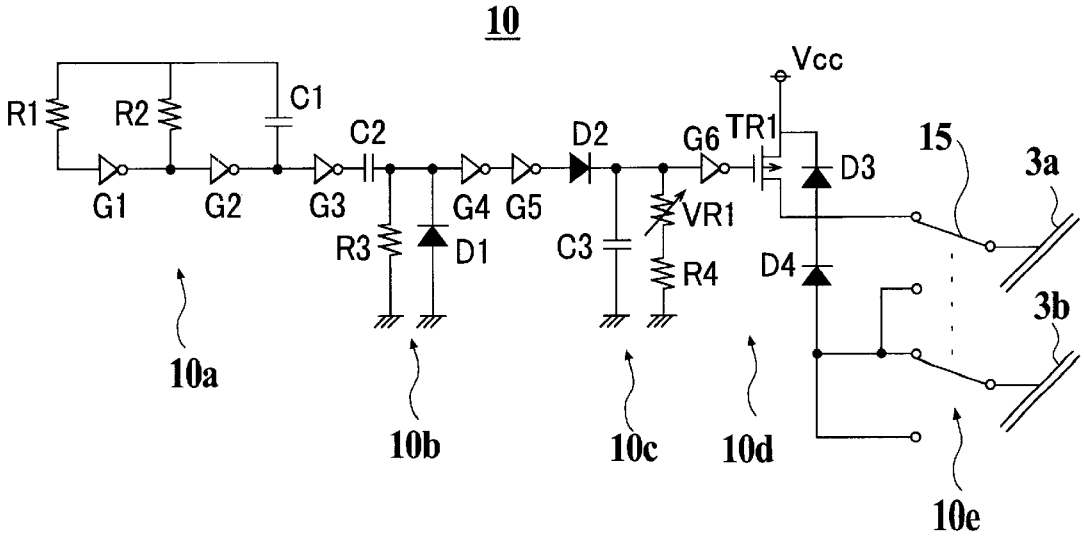
FIG. 5 is a circuit diagram showing an internal structure of a model railroad car control device of a control box on the model railroading shown in FIG. 1.

In FIG. 5, a circuit diagram showing an internal structure of the model railroad car control device 10 is shown. As shown in FIG. 5, the model railroad car control device 10 comprises a fundamental frequency wave generation unit 10*a*, a pulse generation unit 10*b*, a duty control unit 10*c*, an amplifier unit 10*d* and a travel direction control unit 10*e*.

The fundamental frequency wave generation unit 10*a* is composed of a multi vibrator. The multi vibrator is composed of gates (inverters) G1 and G2, resistors R1 and R2, a capacitor C1 and a gate G3.

The capacitor C1 and the resistor R2 determine an oscillating frequency of a PWM (Pulse Width Modulation) wave.

The pulse generation unit 10*b* is composed of a capacitor C2, a resistor R3, a diode D1 and gates G4 and G5.

The capacitor C2 differentiates an output pulse from the gate G3. Thereby, the capacitor C2 generates a rise timing pulse of the PWM wave. The diode D1 of the pulse generation unit 10*b* dose its duty of doing the half-wave rectification of the differentiated wave. That is, the diode D1 does the operation of removing a negative component of the rise timing pulse generated by differentiating the output pulse. The gates G4 and G5 are waveform shaping gates and do their duty of generating a pulse having a narrow width.

The duty control unit 10*c* is composed of a diode D2, a capacitor C3, a variable resistor VR1, a resistor R4 and a gate G6.

The diode D2 is a reverse flow preventing diode to prevent the charge stored in the time constant circuit composed of the capacitor C3, the variable resistor VR1 and the resistor R4, from flowing to the gate G5. According to the duty control unit 10*c*, the bigger the resistance value of the variable resistor VR1 is, the bigger the time constant determined by the capacitor C3, the variable resistor VR1 and the resistor R4 becomes, because the time constant is obtained by multiplying the capacitance of the capacitor C3 by the total resistance of the variable resistor VR1 and the resistor R4. That is, when the time constant becomes bigger, the pulse width becomes wide and the duty ratio that is the load period shown by the pulse width to the idle period, of the operating period becomes bigger (with reference to FIGS. 6A to 6C).

The gate G6 of the duty control unit 10*c* is a waveform shaping gate to shape the pulse smoothed in the time constant circuit into a pulse having a predetermined width. As a result, the gate G6 can change the duty ratio from very little to 100% continuously, that is, from the state in which the load period is very short to the idle time of the operating period to the state in which the idle period is short and the load period is near the operating period, continuously (with reference to FIGS. 6A to 6C).

The amplifier unit 10*d* is composed of a transistor TR1 and diodes D3 and D4.

The pulse inputted to a gate of transistor TR1 is amplified by the transistor TR1, thereby it is possible to drive a low impedance load. The diode D3 rectifies the pulse by removing the overshoot thereof from the pulse, and the diode D4 rectifies the pulse by removing the undershoot thereof from the pulse.

The travel direction control unit 10*e* is composed of a switch 15 to reverse a polarity of a pulse connected to the feeding rails 3*a* and 3*b*. Consequently, the travel direction of the model railroad car 4 is not determined on one predetermined direction.

The model railroad car control device 10 is composed as described above. Further, some examples of the pulse voltage outputted from the model railroad car control device 10 are shown in FIGS. 6A to 6C.

Figure 6A:
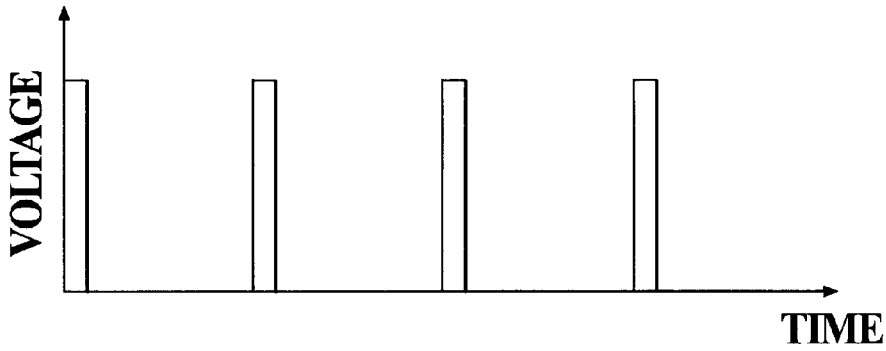
FIGS. 6A, 6B, and 6C are waveform charts showing a state of pulse width modulation.

FIG. 6A shows the waveform change in the case that the duty ratio is small. As described above, the duty ratio is the load period to the idle period of the operating period. As shown in FIG. 6A, when the resistance value of the variable resistor VR1 is small, the load period on the pulse voltage is small.

Figure 6B:
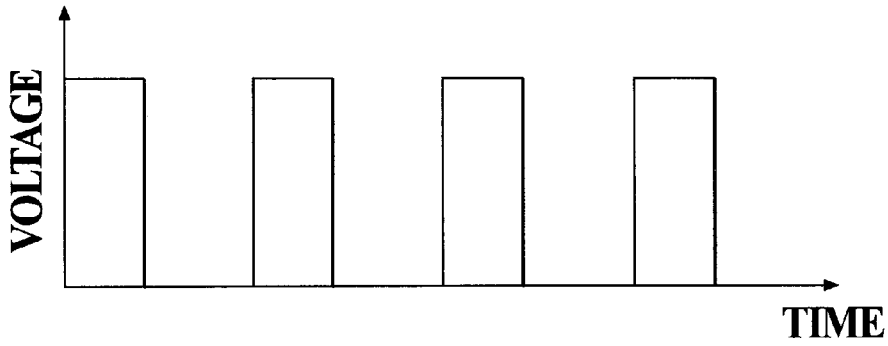

FIG. 6B shows the waveform change in the case that the duty ratio is bigger than one shown in FIG. 6A. As shown in FIG. 6B, when the resistance value of the variable resistor VR1 is changed to bigger, the load period on the pulse voltage becomes bigger.

Figure 6C:
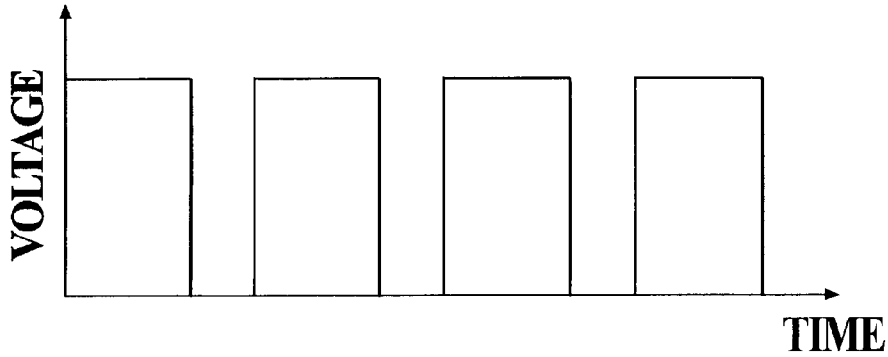

FIG. 6C shows the waveform change in the case that the duty ratio is much bigger than one shown in FIG. 6B. As shown in FIG. 6C, when the resistance value of the variable resistor VR1 is changed to much bigger, the load period on the pulse voltage becomes further bigger.

According to the load of the model tractor 7 or the cleaning model railroad car 8, the pulse voltage is changed as occasion demands.

Figure 7:
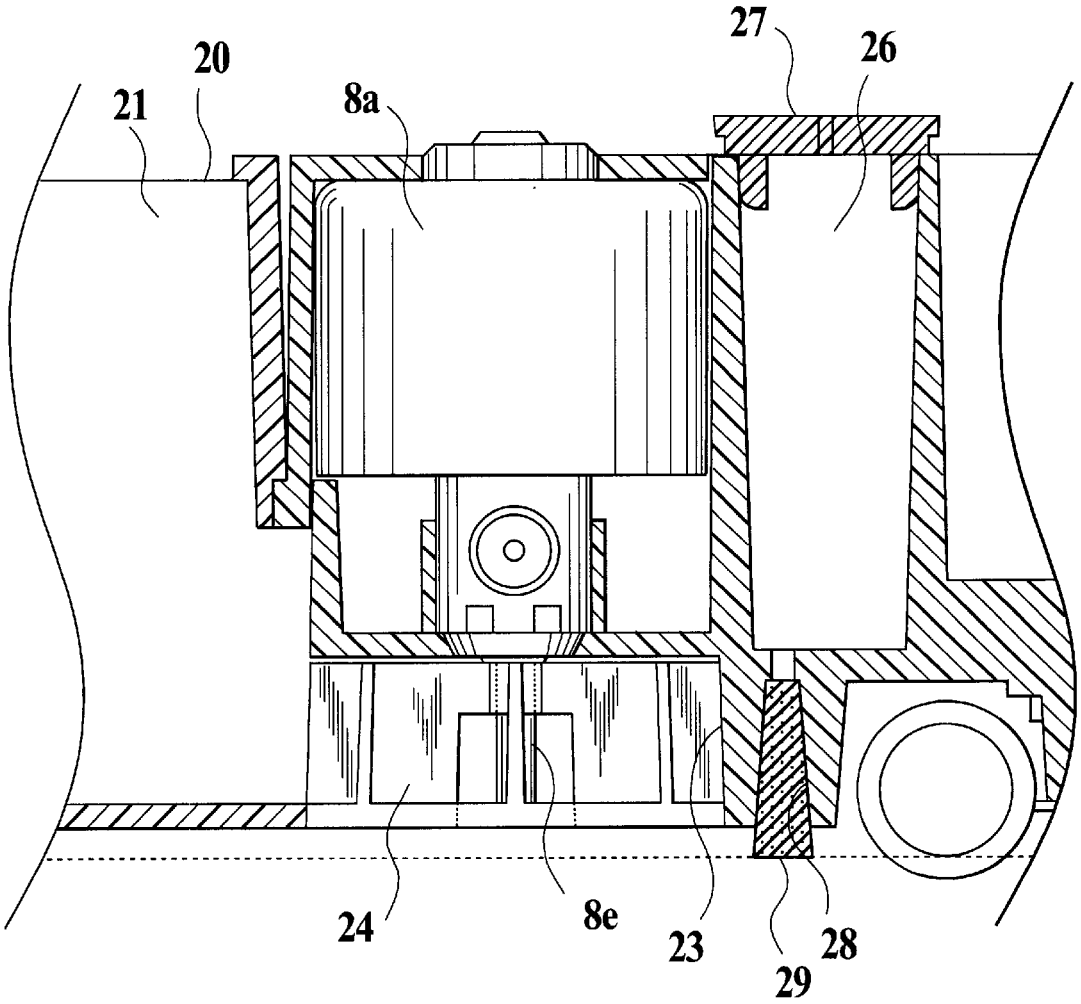
FIG. 7 is a fragmentary expanded sectional schematic view showing a side of the internal structure of the cleaning model railroad car shown in FIG. 3.

Thereinafter, the structure of the cleaning model railroad car 8 will be explained in detail, with reference to FIG. 7. In FIG. 7, a fragmentary expanded sectional schematic view showing a side of the internal structure of the cleaning model railroad car 8 and a side elevation schematic view of the motor 8*a* and the dust collection fan 24 are shown.

As shown in FIG. 7, the cleaning model railroad car 8 comprises a car body 20 and the car body 20 is provided with a dust collection chamber 21. In FIG. 3, the reference numeral 22 denotes a dust collection chamber cover to divide the dust collection chamber 21, wherein the dust collection chamber cover 22 can be installed to and removed from the car body 20. The almost portions on an upper surface and side surfaces of the dust collection chamber cover 22 are composed of nets.

As shown in FIG. 7, a head mounting concave portion 23 is provided at the car body 20. The head mounting concave portion 23 is open toward a lower surface of the car body 20 and communicates with the dust collection chamber 21.

In the head mounting concave portion 23, a motor shaft 8*e* provided at the head drive motor 8*a* is projected. In the state that the motor shaft 8*e* is projected in the head mounting concave portion 23, a dust collection fan 24, a polishing head 25 and the like can be installed to and removed from the motor shaft 8*e*. In order to hold the dust collection fan 24, the polishing head 25 and the like to the predetermined position of the motor shaft 8*e* and to rotate them with the motor shaft 8*e*, for example, the motor shaft 8*e* may comprise a claw portion to be engaged with the following shaft member 24*d* of the dust collection fan 24, the following shaft member 25*a* of the polishing head 25 and the like. Further, the motor shaft 8*e* may comprise a screw to screw the dust collection fan 24, the polishing head 25 and the like thereto.

Figure 8A:
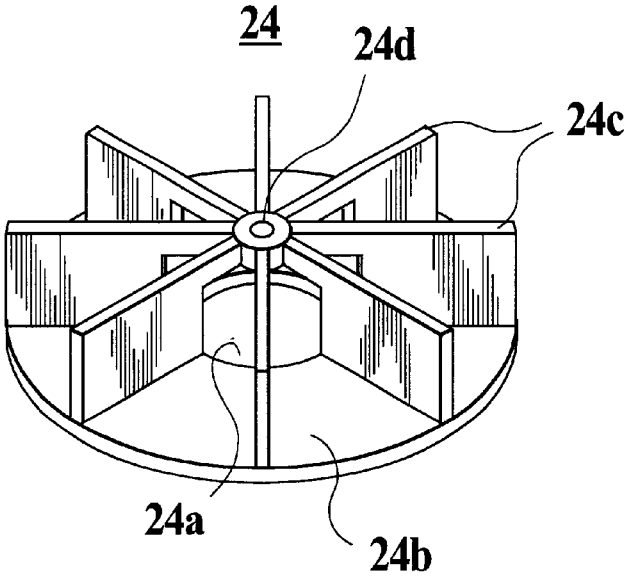
FIGS. 8A and 8B are views showing a dust collection fan.
Figure 8B:
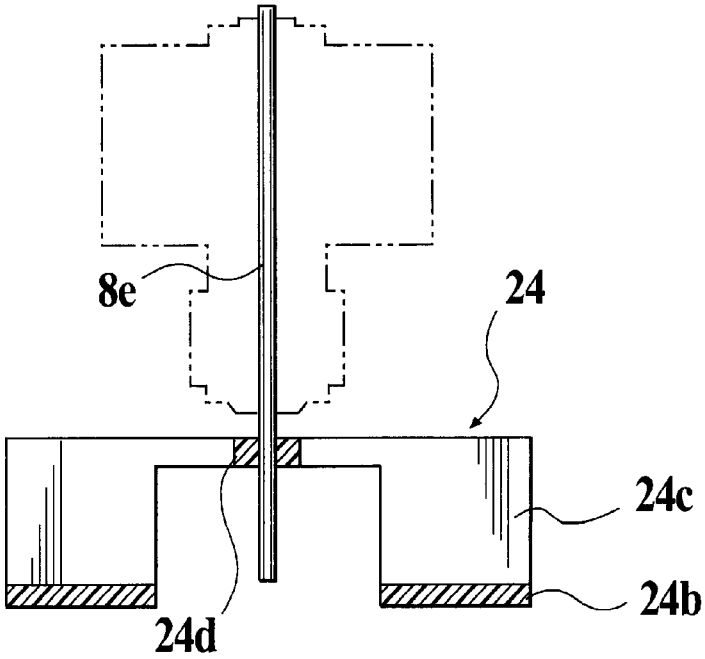

The dust collection fan 24 will be explained with reference to FIGS. 8A and 8B. In FIGS. 8A and 8B, a perspective view and a sectional view of the dust collection fan 24 are shown respectively.

As shown in FIG. 8A and FIG. 8B, the dust collection fan 24 comprises a circular plate (a shroud) 24*b* having a hole 24*a* at a center position thereof and a plurality of blades 24*c* provided to the circular plate 24*b* in standing radially. The upper end portion of each of the plurality of blades 24*c* is extended to the center of the dust collection fan 24, to be combined with one shaft member 24*d*. The shaft member 24*d* can be fitted with the motor shaft 8*e*.

The dust collection fan 24 is provided at the motor shaft 8*e* in a state that the circular plate 24*b* is below the blades 24*c*. When the dust collection fan 24 is provided at the motor shaft 8*e*, the lower surface of the circular plate 24*b* on the dust collection fan 24 is a coplanar to the lower surface of the car body 20 (with reference to FIG. 7). As described above, the dust collection fan 24 is provided at the motor shaft 8*e* in the state that the circular plate 24*b* is below the blades 24*c* in order to prevent the dust from falling down the dust collection fan 24 as possible while collecting the dust.

Figure 9A:
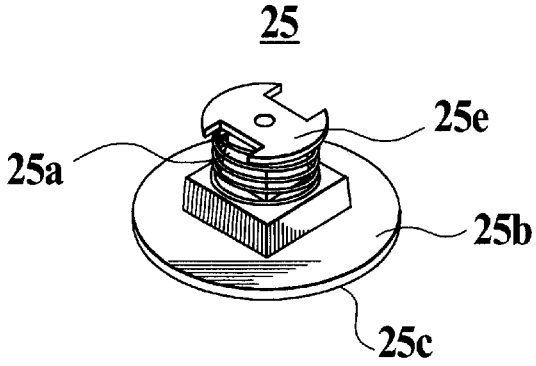
FIGS. 9A, 9B and 9C are views showing a polishing head.
Figure 9B:
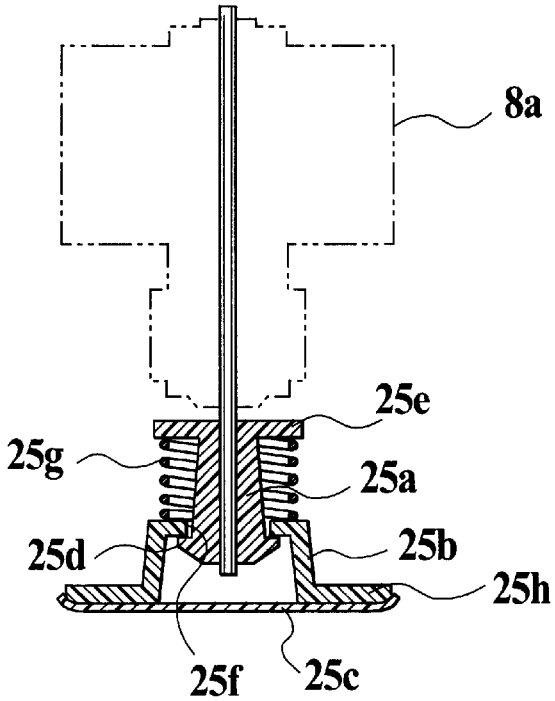
Figure 9C:
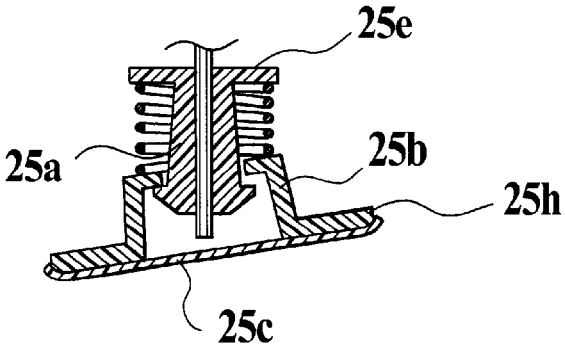

The polishing head 25 will be explained with reference to FIGS. 9A, 9B and 9C. In FIG. 9A and FIGS. 9B and 9C, a perspective view and sectional views of the polishing head 25 are shown respectively.

As shown in FIGS. 9A to 9C, the polishing head 25 comprises a shaft member 25*a*, a mounting member 25*b* supported against the shaft member 25*a*, and a polishing member 25*c* such as a paper, a file, a cloth or the like, attached to the mounting member 25*b*.

The shaft member 25*a* comprises a claw portion 25*d* at the lower end thereof and a flange 25*e* at the upper end thereof.

The mounting member 25*b* is formed in a hat shape and provided a hole 25*f* at the center of the top plate thereof. The shaft member 25*a* is inserted into the hole 25*f*, and the claw portion 25*d* is engaged with the lower surface of the edge portion of the hole 25*f* on the top plate. The diameter of the hole 25*f* on the mounting member 25*b* is a little bigger than the outer diameter of the shaft member 25*a*. As a result, the mounting member 25*b* can move upward and downward and incline to the shaft member 25*a*. Around the shaft member 25*a*, a pushing spring 25*g* is wound. The upper end of the pushing spring 25*g* is contacted with the flange 25*e*, and the lower end of the pushing spring 25*g* is contacted with the upper surface on the top plate of the mounting member 25*b*.

The polishing member 25*c* such as a paper, a file, a cloth or the like, is attached to the lower surface on the flange 25*h* of the mounting member 25*b*.

According to the structure as described above, it is possible to contact the polishing member 25*c* of the polishing head 25 with the feeding rails 3*a* and 3*b* certainly.

As shown in FIG. 7 and FIG. 3, a tank 26 capable of storing a cleaning liquid thereto is provided to the car body 20. In FIG. 3 and FIG. 7, the reference numeral 27 denotes a cover for the tank 26. Further, a hole 28 in an arc is provided near the head mounting concave portion 23 on the car body 20. The hole 28 is open toward a lower surface of the car body 20 and communicated with the tank 26. The hole 28 can be squeezed a wiping member 29 thereto so that the wiping member 29 can be inserted in and taken off from the hole 28. The wiping member 29, for example, may be a brush or the like, when the dust collection fan 24 or the dry type of polishing head 25 to which a paper, a file or the like is attached, is installed at the motor shaft 8*e*. Further, the wiping member 29 may be a sponge or the like, when another type of polishing head 25 to which a silicon cloth or the like is attached, is installed at the motor shaft 8*e*.

According to the cleaning model railroad car 8 having a structure as described above, the dust collection fan 24 is provided at the motor shaft 8*e*, thereby it is possible to remove a dust and the like from the feeding rails 3*a* and 3*b* and the periphery thereof.

In this case, when the wiping member 29 is squeezed into the hole 28 in an arc and the cleaning model railroad car 8 runs in a travel direction that the dust collection fan 24 is forward the wiping member 29, the wiping member 29 can function as a wall for collecting a dust regardless of storage of the cleaning liquid. Accordingly, it is possible to increase more efficiency of collecting a dust. Further, even if the dust collection fan 24 does not operate, it is possible to wipe the feeding rails 3*a* and 3*b* by the wiping member 29.

Further, according to the cleaning model railroad car 8 having a structure as described above, the polishing head 25 is provided at the motor shaft 8*e*, instead of the dust collection fan 24, thereby it is possible to polish the feeding rails 3*a* and 3*b*.

In this case, when the wiping member 29 as a sponge is squeezed into the hole 28 in an arc, the cleaning liquid is stored in the tank 26, and the cleaning model railroad car 8 runs in a travel direction that the polishing head 25 is backward the wiping member 29, the wiping member 29 can polish the feeding rails 3*a* and 3*b* with the cleaning liquid, thereafter the polishing head 25 can further polish the feeding rails 3*a* and 3*b* with the cleaning liquid. Accordingly, it is possible to clean the feeding rails 3*a* and 3*b* more effectively.

Although the present invention has been explained according to the above-described embodiment, it should also be understood that the present invention is not limited to the embodiment and various changes and modifications may be made to the invention without departing from the gist thereof.

For example, in accordance with the model railroad car 4 according to the embodiment of the present invention, although the wiping member 29 has the structure capable of being installed to and removed from the cleaning model railroad car 8, the wiping member 29 may have a structure capable of being contacted with and separated from the feeding rails 3*a* and 3*b*.

According to the present invention, a main effect can be obtained, as follows.

The cleaning model railroad car comprises: the car body; wheels attached to the car body, for riding on the rails; the motor attached to the car body, to which the electrical current is supplied through the wheels on the rails and the motor shaft is provided; the dust collection chamber provided at the car body; the head mounting concave portion provided below the motor, for opening toward the lower surface of the car body below thereof and communicating with the dust collection chamber; and the cleaning head provided at the motor shaft projected in the head mounting concave portion, which can be installed to and removed from the motor shaft.

Accordingly, it is possible to provide various cleaning heads at the cleaning model railroad car. Consequently, it is possible to do cleaning the rails by one cleaning model railroad car according to various objects.

The entire disclosure of Japanese Patent Application No. Tokugan hei-11-137502 filed on May 18, 1999 including specification, claims, drawings and summary are incorporated herein by reference in its entirety.

What is claimed is:

1. A cleaning model railroad car comprising:

a car body;

wheels attached to the car body, for riding on rails;

a motor attached to the car body, to which an electrical current is supplied through the wheels on the rails and a motor shaft is provided;

a dust collection chamber provided at the car body;

a head mounting concave portion provided below the motor, to open toward a lower surface of the car body and communicating with the dust collection chamber;

a cleaning head being a dust collection fan provided at the motor shaft projected in the head mounting concave portion, which is installed to and removed from the motor shaft;

a tank attached to the car body, to store a cleaning liquid therein; and a wiping unit which can be installed to and removed from the car body, to wipe the rails with the cleaning liquid of the tank.

2. The cleaning model railroad car according to claim 1, wherein the wiping unit is attached to the car body to contact and be separated from the rails, to wipe the rails with the cleaning liquid of the tank.

3. The cleaning model railroad car according to claim 1, wherein the dust collection fan comprises a circular plate having a hole at a center position of the circular plate, at a lower end portion thereof.

4. A cleaning model railroad car, comprising:

a car body;

wheels attached to the car body, for riding on rails;

a motor attached to the car body, to which an electrical current is supplied through the wheels on the rails and a motor shaft is provided;

a dust collection chamber provided at the car body;

a head mounting concave portion provided below the motor, for opening toward a lower surface of the car body below thereof and communicating with the dust collection chamber;

a cleaning head provided at the motor shaft projected in the head mounting concave portion, which can be installed to and removed from the motor shaft; and a motor driving circuit for driving the motor, comprising a full wave rectifier circuit and a smoothing capacitor.

5. A cleaning model railroad car comprising:

a car body;

wheels attached to the car body, to ride on rails;

a head mounting concave portion provided at the car body, to open toward a lower surface of the car body below thereof;

a cleaning head which is a polishing head provided at the head mounting concave portion through a spring, which can be installed to and removed from the head mounting concave portion and which can move upward and downward and incline to the head mounting concave portion;

a tank attached to the car body, to store a cleaning liquid therein; and a wiping unit which can be installed to and removed from the car body, for wiping the rails with the cleaning liquid of the tank.

6. The cleaning model railroad car according to claim 5, further comprising:

a motor attached to the car body, to which an electrical current is supplied through the wheels on the rails and a motor shaft is provided;

wherein the cleaning head is provided at the motor shaft projected in the head mounting concave portion, and can be installed to and removed from the motor shaft and be rotated by the motor.

7. The cleaning model railroad car according to claim 5, wherein the wiping unit is attached to the car body so as to be contacted with and separated from the rails, for wiping the rails with the cleaning liquid of the tank.

8. A cleaning model railroad car, comprising:

a car body;

wheels attached to the car body, for riding on rails;

a motor attached to the car body, to which an electrical current is supplied through the wheels on the rails and a motor shaft is provided;

a dust collection chamber provided at the car body;

a head mounting concave portion provided below the motor, for opening toward a lower surface of the car body below thereof and communicating with the dust collection chamber;

a cleaning head which is a dust collection fan provided at the motor shaft projected in the head mounting concave portion, which can be installed to and removed from the motor shaft; and a motor driving circuit for driving the motor, comprising a full wave rectifier circuit and a smoothing capacitor.

9. A cleaning model railroad car, comprising:

a car body;

wheels attached to the car body, for riding on rails;

a head mounting concave portion provided at the car body, for opening toward a lower surface of the car body below thereof;

a cleaning head which is a polishing head provided at the head mounting concave portion through a spring, which can be installed to and removed from the head mounting concave portion and which can move upward and downward and incline to the head mounting concave portion; and a motor driving circuit for driving the motor, comprising a full wave rectifier circuit and a smoothing capacitor.

10. A cleaning model railroad car comprising:

a car body;

wheels attached to the car body, for riding on rails;

a motor attached to the car body, to which an electrical current is supplied through the wheels on the rails and a motor shaft is provided;

a dust collection chamber provided at the car body;

a head mounting concave portion provided below the motor, to open toward a lower surface of the car body and communicating with the dust collection chamber;

a cleaning head being a dry polishing head provided at the motor shaft projected in the head mounting concave portion, through a spring, which can be installed to and removed from the motor shaft and which can move upward and downward and incline to the motor shaft;

a tank attached to the car body, to store a cleaning liquid therein; and a wiping unit which can be installed to and removed from the car body, for wiping the rails with the cleaning liquid of the tank.

11. The cleaning model railroad car according to claim 10, wherein the wiping unit is attached to the car body so as to be contacted with and separated from the rails, to wipe the rails with the cleaning liquid of the tank.

* * * * *